US006009961A

United States Patent [19]

Pietrobelli et al.

[11] Patent Number: 6,009,961

[45] Date of Patent: Jan. 4, 2000

[54] UNDERREAMER WITH TURBULENCE CLEANING MECHANISM

[76] Inventors: Fausto Pietrobelli; Alejandro Pietrobelli, both of Ctro. Cial. Tacarigua Ave Intercomunal, Tia Juana, Venezuela

[21] Appl. No.: 09/253,498

[22] Filed: Feb. 19, 1999

Related U.S. Application Data

[63] Continuation of application No. 08/926,637, Sep. 10, 1997, Pat. No. 5,896,940.

[51] Int. Cl.[7] ..... E21B 7/28

[52] U.S. Cl. ..... 175/269

[58] Field of Search ..... 175/269, 279, 175/271, 273, 274

[56] References Cited

U.S. PATENT DOCUMENTS 1,478,306 12/1923 Sweetman .
3,171,503 3/1965 Shirley ..... 175/269
4,431,065 2/1984 Andrews ..... 175/269
4,461,361 7/1984 Fuchs .
5,139,098 8/1992 Blake .
5,402,856 4/1995 Warren et al. ..... 175/57

*Primary Examiner*—Frank Tsay
*Attorney, Agent, or Firm*—J. Sanchelima

[57] ABSTRACT

An underreamer with pressurized water activated lateral cutters pivotally mounted thereon and being spring biased to urge them in longitudinal alignment with the underreamer. A removable constrictor socket is cooperatively mounted adjacent to the distal end of the piston rod so that a user can select one of several designs depending on the magnitude of drill fluid pressure to be applied on the bottom of the well. The lower end of the underreamer is provided with several contiguous cutting teeth arranged in a circle with a relatively small separation inbetween so that it may continue to work even if the well collapses. The cutting teeth enhance the turbulence of the drill fluid. The underreamer is lubricated with drilling fluid applied up to a predetermined pressure without opening the lateral cutters. After a given predetermined amount of pressure, the lateral cutters open perpendicularly.

4 Claims, 3 Drawing Sheets

UNDERREAMER WITH TURBULENCE CLEANING MECHANISM

This is a Continuation of application Ser. No. 08/926,637, filed on Sep. 10, 1997 now U.S. Pat. No. 5,896,940.

BACKGROUND OF THE INVENTION

1. Field of the Invention

The present invention relates to underreamers used in the perforation of wells, and more particularly, oil wells.

2. Description of the Related Art

Underreamers are tools used to expand drilled wells, such as oil wells, and many times these wells extend for several thousands of feet below the surface. To achieve this, sections are added as the drilling process progresses. However, when a well collapses, the entire apparatus needs to be taken out and different tools installed to meet the requirements.

The present invention overcomes the shortcomings of other underreamers because it also includes cutting teeth, mounted at the lower end of the underreamer apparatus, that are designed to continue operating even when the drilling well has collapsed. Also, sometimes a section of the well needs to be enlarged, requiring a different tool. Thus, the apparatus does not have to be removed from the drilling well when this happens avoiding having to pull out the tools and consequently representing considerable savings in operating costs. The teeth, being aligned and spaced apart, permit the underreamer to continue removing dirt from the bottom.

Also, the present invention discloses blade assemblies mounted to the lateral of the body that have double functionality, namely, enlarging a well section and cutting a pipe casing previously installed inside the well.

One of the first U.S. patents for underreamers is U.S. Pat. No. 1,478,306 issued to Sweetman in 1920. It provides for the use of lateral cutters which are raised through the application of pressurized water to a spring-loaded piston head. No cutting teeth at the lower end of the underreamer or removable water constricting socket member, however, are disclosed.

Another related reference is U.S. Pat. No. 4,461,361 issued in 1984 to Fuchs. The end cutters 16, however, would be obstructed if the well collapses since they will be trap the mud making it impossible to move.

Another related patent reference corresponds to U.S. Pat. No. 5,139,098 issued to Blake in 1992. This patent discloses a Combined Drill and Underreamer Tool that includes an underreamer tool with a drill bit assembly at the end. The cutting arms of the underreamer tool are actuated (expanded) against their retracted spring biased position. A fluid by pass is provided to clean the drill bit assembly which is routed from a distribution chamber 35, through coaxial lateral ports 42, through bypass conduit 54 along elongated channels 47, and into internal chamber 70. The fluid is them directed towards drill bit 24. With a spool-valve like device 110, up to 30% of the fluid is diverted to the underreamer to actuate it and lubricate it. Thus, the drill fluid is divided in two independent paths. More important, the circuitous path of bypass conduit 54 loses its cleaning pressure by the time it reaches internal chamber 70. Also, having a body of water (to make it worse is variable or bypassable) at the periphery of the tool introduces an additional load to the rotation motor. finally, having bypass conduit 54 flush with the peripheral wall exposes the device to being punctured and causing leads. The present invention, on the other hand, directs the pressurized drilling fluid towards the cutting teeth, at an angle, and the latter act as a water impeller to create a turbulence that dislodges any debris and pushes it upwardly. Depending on the soil characteristics, constricting sockets of different dimensions can be selected to prevent overflow, while still being sufficient, after a predetermined magnitude of pressure, to overcome the spring bias.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide an underreamer apparatus that can continue to work even if the well being worked on collapses.

It is another object of the present invention to provide an underreamer that includes a blade assembly with contiguous cutting teeth disposed in a circle, and with some inclination with respect to the horizontal plane being cut. The cutting teeth rotate and act as an impeller for the drill fluid causing turbulences that dislodge any trapped debris.

It is another object of this invention to provide an underreamer that includes a piston assembly with a replaceable constrictor socket so that the pressure of the drilling fluid can be varied, thus changing the pressure applied to the bottom of the well being worked on and the cutting teeth.

It is another object of this invention to provide an underreamer with at least one retractable cutting blade assembly that can be readily replaced in the field.

It is another object of this invention to provide an underreamer that can be readily verify the cuttings made through tube casings.

It is yet another object of this invention to provide such an underreamer that is virtually inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
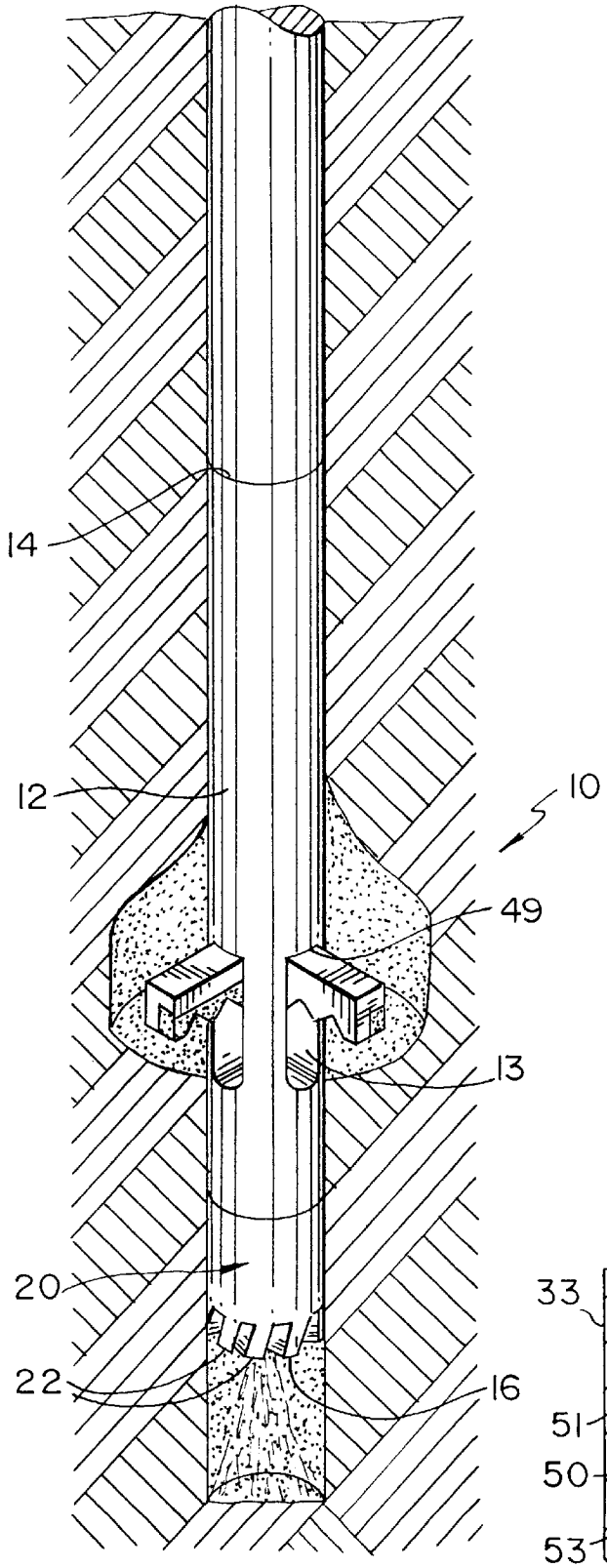
FIG. 1 is an isometric view from the top of the underreamer inside a well.

Referring now to the drawings, and in particular FIG. 1, where the present invention is generally referred to with numeral 10, it can be observed that it basically includes elongated body 12 with ends 14 and 16.

End 14 includes threaded box 15 which permits the removable threaded attachment of the lower end of a string of drill pipe members. End 16 includes cutting assembly 20 with several contiguous cutting teeth 22 aligned in a circle with a relative small separation between contiguous teeth. Cutting teeth 22 are disposed at an angle of inclination and designed to stimulate the turbulence of the liquid flow once the latter reaches end 16. The turbulence aids cutting assembly 20 to destroy and displace any trapped formation and/or cement between teeth and helps maintaining the teeth clean for maximum abrasive action. Cutting assembly 20, in the preferred embodiment, has a tubular configuration with central opening 23 through which the pressured drilling fluid (typically water with other chemicals added) flow travels out. The liquid then finds its way up through the space defined by the outer surface of body 12 and the well. The turbulence of the drilling fluid aids cutting teeth to drill a well with higher efficiency than other known devices and the teeth also impel the fluid up. Cutting assembly 20 is removably mounted to the bottom of elongated body 12 through mating threaded portions 24 and 17.

Figure 2A:
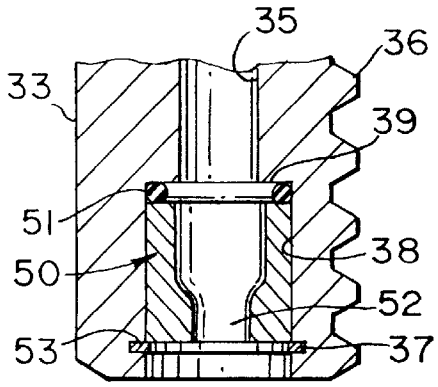
FIG. 2A is a partial cross section of an enlarged view of the lower end of the piston showing the constricting socket mounted thereto.
Figure 2:
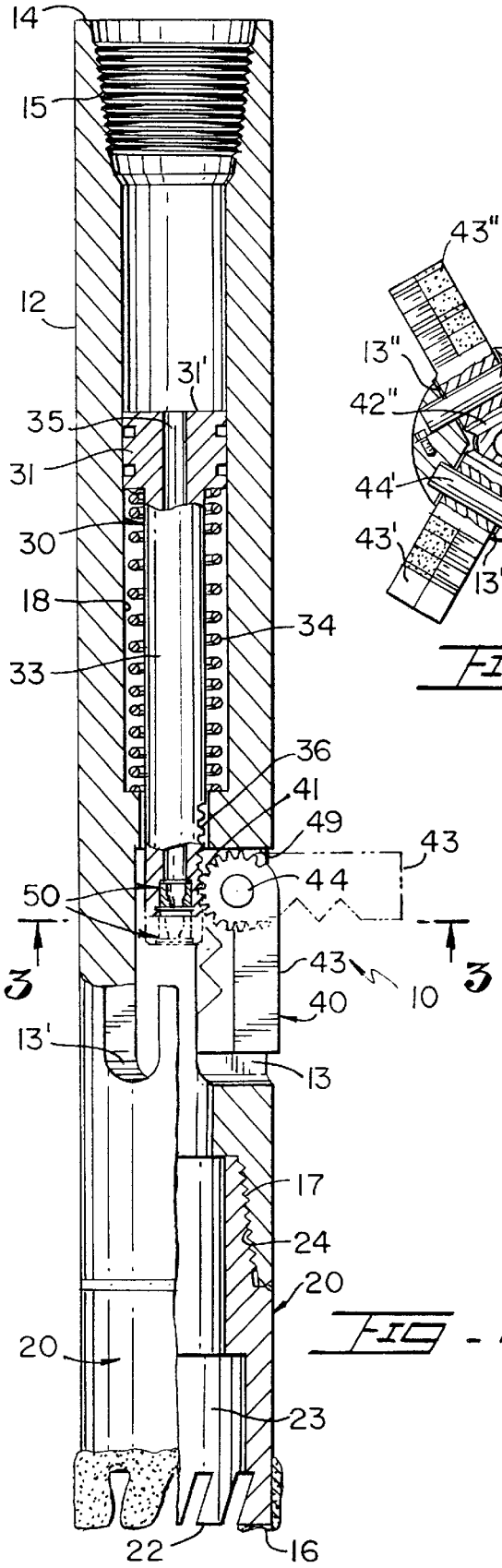
FIG. 2 is a partial cross section of a side elevational view of the present invention shown in FIG. 1.

As best seen in FIG. 2, elongated body 12 has chamber 18 that houses spring loaded piston assembly 30. Spring loaded piston assembly 30 includes piston head 31 and tubular rod member 33 with spring 34 cooperatively urging piston head 31 axially upwardly. Spring loaded piston assembly 30 includes through opening 35 through which the drilling fluid passed. Tubular piston rod member 33 ends with racks 36; 36' and 36" which include several teeth of a substantially triangular configuration. Counterbore 38 is located at the lowermost portion of tubular piston rod member 33. Counterbore 38 is designed to cooperatively receive replaceable constricting socket 50. Counterbore 38 includes, at its upper end, shoulder 39 against which O-ring 51 is positioned, followed by constricting socket 50 and kept in place in packed compression by retaining ring 53 that is inserted in cooperating peripheral groove 37.

Figure 6A:
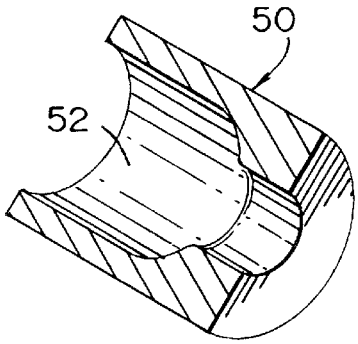
FIG. 6A is a cross section of an isometric view of a constricting socket, subject of the present invention.
Figure 6B:
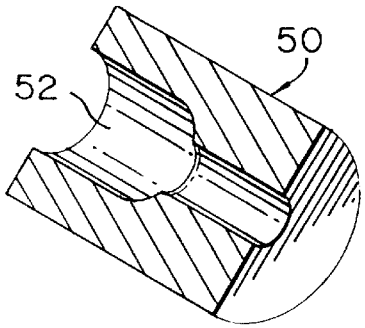
FIG. 6B is a cross section of an isometric view of the constricting socket having another internal dimensions.
Figure 7:
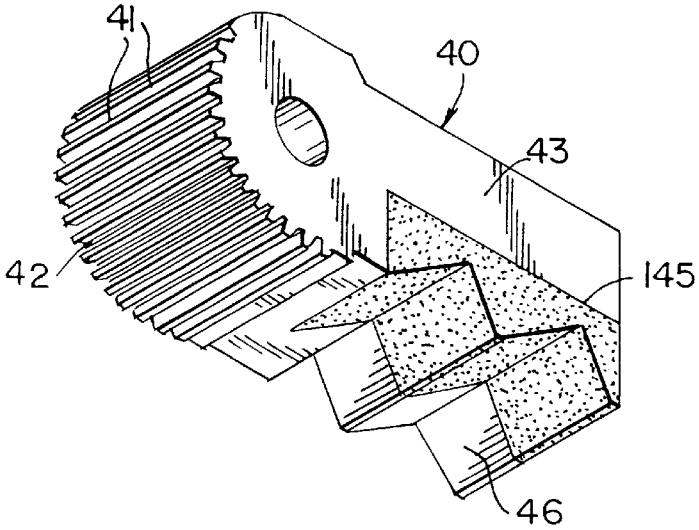
FIG. 7 is an isometric view of the lateral cutting blades.
Figure 8:
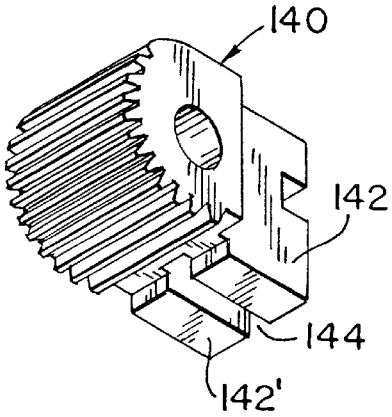
FIG. 8 is an isometric view of another alternative for the lateral cutting blades.

Constricting socket 50, in the preferred embodiment, includes through opening 52 with decreasing diameter from the top to the bottom, and is intended to restrict the drilling fluid flow, thus increasing its escape pressure. Constricting socket 50 may have different diameters depending on the amount of pressure and fluid lubrication desired. The restriction of the flow of the liquid will determine the pressure applied to the end of the well being worked on. Constricting socket 50, in the preferred embodiment, is cylindrical and is removably and snugly mounted inside counterbore 38 and kept in place by retainer ring 53. Depending on the job, a user may require more pressure (and less water at the end) applied to the end of the well and thus constricting socket 50 will have a smaller through opening 52, as best seen in FIG. 6B. Or, the requirements dictate more volume of water and lower pressure, then a larger opening 52 is appropriate, as shown in FIG. 6A.

Figure 3:
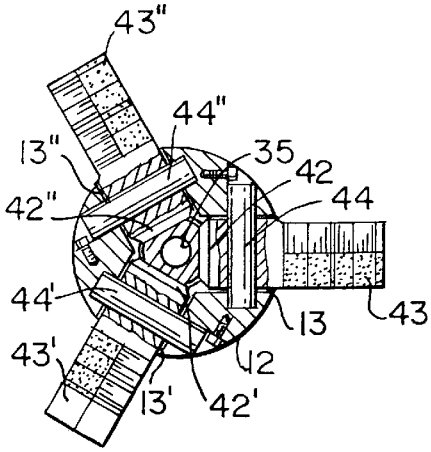
FIG. 3 is partial cross sectional view of this invention taken along lines 3—3, showing the lateral cutting blades in extended position.
Figure 4:
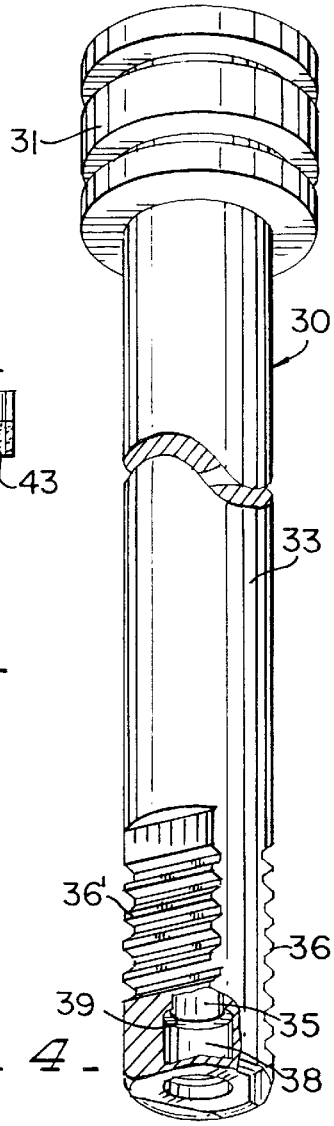
FIG. 4 is an isometric view of a piston used in the preferred embodiment with a partial cross section at the bottom.
Figure 5:
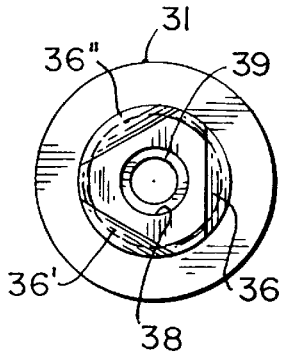
FIG. 5 is a bottom view of the piston shown in FIG. 4.

The fluid force (pressure multiplied by the effective surface area 31' of piston head 31) applied to spring loaded piston assembly 30 causes rod member 33 to move down overcoming the bias of spring 34 after a predetermined amount of fluid pressure is applied. Racks 36; 36' and 36" cooperatively engage with teeth 41; 41' and 41" of cutting members 43; 43' and 43", respectively. Racks 36; 36' and 36" are then moved downwardly and cutting members 43; 43' and 43" swing outwardly through slots 13; 13' and 13" thereby extending perpendicular with respect to elongated body 12. This is particularly useful since upper edge 49 acts as support to maintain cutting members 43; 43' and 43" fully extended for maximum diameter of cutting, as seen in FIGS. 2 and 3.

Lateral cutting assembly 40 is shown in FIG. 2 in retracted position and in phantom in the distended or working position. As described above, lateral cutting assembly 40 basically includes cutting members 43; 43' and 43" that are pivotally mounted to elongated body 12 by pins 44; 44' and 44", respectively. Elongated body 12 has lateral cavities 13; 13' and 13" to cooperatively house cutting members 43; 43' and 43" when they are in retracted position. In this manner, lateral cutting assembly 40 does not obstruct the drilling operation when retracted.

Cutting members 43; 43' and 43", in the preferred embodiment, have partial pinions 42; 42' and 42" with teeth 41; 41' and 41" that, in the present invention, is located adjacent to rack 36; 36' and 36" of spring loaded piston assembly 30, respectively. Cutting or blade members 43; 43' and 43" open up to 90 degrees upon application of predetermined amount of fluid pressure through the action of piston head 31 inside reamer 10. Complementing teeth in members 43; 43' and 43" cooperate to level the cutting plane so that the task is divided among the three cutting members. Cutting members 43; 43' and 43" are covered with coating of a hardening and abrasive resistant compound such as a tungsten carbide product like Kutrite® a trademark of B & W metals located in Houston, Tex. that is welded to the tool and is intended to prolong its operating life. The outer ends of cutting members 43; 43' and 43" include flat surface 45 and teethed surface 46. Flat surface 45 is formed as an extension of teethed surface 46 with Kutrite® so that teethed surface 46 provides the necessary structural support for the abrasive material formed on flat surface 45.

Cutting assembly 140 is an alternate embodiment and includes rectangular cutting members 142 and 142' disposed adjacent to each other with space 144 inbetween. Cutting assembly 140 has been found to cut away any pipe casing inside the well in a minimum of time and maximum efficiency. The simplified design of the present invention allows a user to readily change cutting assembly 40 for cutting assembly 140. With the above mentioned characteristic that permits a 90 degrees opening of cutting assembly 140, a user can readily ascertain whether a window in the casing has been made and its approximate dimensions. As seen in FIG. 9, reamer 10 is pulled up with expanded assemblies 140 and when cutting assembly 140 engages the upper edge of the window cut out, the pulling force applied is increased verifying the existence of this upper edge. Then, reamer 10 is released, the distance traveled measured, until assemblies 140 reach the lower edge of the window cut out (this portion is shown in phantom). This verifies the lower end.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. In an underreamer apparatus for enlarging wells and cutting the well's casing, said underreamer includes first and second ends, said first end includes a threaded box, and including a spring loaded piston assembly coaxially housed within said underreamer, said piston assembly includes a piston head and a piston rod having two ends, with one of the ends attached to said piston head and having a rack assembly adjacent to said other end, said piston head and rod having a longitudinally extending through opening, and further including at least one lateral cutting means in meshed engagement with said rack assembly, said cutting means being urged inwardly within said underreamer by said spring loaded piston assembly, and said lateral cutting means being selectably extended outwardly and perpendicularly with respect to said underreamer by a source of pressurized fluid that is applied to said piston assembly, the improvement comprising:

A) removably means for constricting said pressurized fluid passing through said through opening, and being positioned at said other end of said piston rod so that a substantial portion of said pressurized fluid is axially directed towards the bottom of the well being worked on; and B) cutting means mounted to said second end having a plurality of contiguously disposed cutting teeth with a relatively small separation between said contiguous cutting teeth, and said cutting teeth extending longitudinally from the periphery of said second end so that said pressurized fluid directed to the bottom is forced to pass inbetween said cutting teeth that act as a blade impeller to push said fluid upwardly and to create sufficient turbulence to dislodge foreign material trapped between said teeth.

2. The improvement set forth in claim 1 including at least two lateral cutting means cooperatively mounted to said underreamer to cut over a plane perpendicular to the longitudinal axis of said underreamer and further including each a plurality of triangular teeth that are complementary to each other so that the triangular teeth of one lateral cutter means complements and levels the other's path.

3. The improvement set forth in claim 2 wherein said cutting teeth are cooperatively disposed at an angle with respect to the longitudinal axis of said underreamer so that the turbulence created about said cutting teeth is enhanced.

4. The improvement set forth in claim 3 wherein said removable means for constructing said pressurized fluid includes a cylindrical socket having a through aperture with decreasing diameter from one end of said cylindrical socket to other end and said other end of said piston rod includes a counterbore with a shoulder against which the end of said socket with the larger aperture diameter is mounted and further including retaining means for removably keeping said cylindrical socket in position.

* * * * *